US006035612A

United States Patent [19]

Draghetti et al.

[11] Patent Number: 6,035,612

[45] Date of Patent: Mar. 14, 2000

[54] PRODUCT WRAPPING METHOD AND MACHINE

[75] Inventors: Fiorenzo Draghetti, Medicina; Silvano Boriani, Bologna, both of Italy

[73] Assignee: Societa Per Azioni, Bologna, Italy

[21] Appl. No.: 09/027,963

[22] Filed: Feb. 23, 1998

[30] Foreign Application Priority Data

Feb. 24, 1997 [IT] Italy ..... BO97A0086

[51] Int. Cl.[7] ..... B65B 11/28

[52] U.S. Cl. ..... 53/466; 53/176; 53/201; 53/234

[58] Field of Search ..... 53/234, 168, 170, 53/171, 176, 466, 207, 201, 389.3

[56] References Cited

U.S. PATENT DOCUMENTS

| | | | |
|---|---|---|---|
| 1,485,598 | 3/1924 | Croxford | 53/234 |
| 3,253,387 | 5/1966 | Schermund | 53/234 |
| 3,537,232 | 11/1970 | Mateyka et al. | 53/234 |
| 4,265,073 | 5/1981 | Seragnon | 53/201 |
| 4,509,310 | 4/1985 | Focke et al. | 53/201 |
| 5,154,035 | 10/1992 | Cavazza | 53/234 |
| 5,269,117 | 12/1993 | Borianni et al. | 53/234 |
| 5,533,323 | 7/1996 | Osti et al. | 53/234 |
| 5,657,609 | 8/1997 | Spada et al. | 53/234 |
| 5,701,718 | 12/1997 | Spada | 53/201 |
| 5,784,855 | 7/1998 | Focke et al. | 53/234 |
| 5,855,106 | 1/1999 | Koyama et al. | 53/201 |

FOREIGN PATENT DOCUMENTS

| | | | |
|---|---|---|---|
| 529404 | 3/1993 | European Pat. Off. . | |
| 751069 | 2/1997 | European Pat. Off. . | |
| 756993 | 2/1997 | European Pat. Off. . | |
| 2344450 | 10/1977 | France . | |
| 402052 | 2/1932 | United Kingdom | 53/201 |
| 2222396 | 1/1989 | United Kingdom | 53/201 |
| 2235913 | 3/1991 | United Kingdom . | |
| 2101958 | 1/1993 | United Kingdom . | |

*Primary Examiner*—John Sipos
*Attorney, Agent, or Firm*—Klauber & Jackson

[57] ABSTRACT

A method and machine for wrapping a product, whereby the product is fed to a loading station of a folding conveyor in time with a respective wrapping sheet, which is fed in one of two different positions in relation to the product; the folding conveyor being operated to advance the product and the relevant wrapping sheet along a folding path extending through first and second wrapping devices, which are selectively operated to fold the wrapping sheet into a tube about the product; the choice of one or the other of the wrapping devices depending on which of the two positions is occupied by the wrapping sheet in the loading station.

21 Claims, 4 Drawing Sheets

PRODUCT WRAPPING METHOD AND MACHINE

BACKGROUND OF THE INVENTION

The present invention relates to a method of wrapping products with selective functioning wrapping devices.

More specifically, the present invention relates to a method of wrapping groups of packets of cigarettes, to which the following description refers purely by way of example.

Groups of packets of cigarettes are normally wrapped by feeding each group to a cartooning machine, wrapping the group in a respective first wrapping comprising a sheet of wrapping material, e.g. semirigid cardboard, to form a respective carton of packets, and then transferring the carton to an overwrapping machine and overwrapping the carton in a respective second wrapping comprising a sheet of overwrapping material folded about the first wrapping.

In the art, wrapping machines are known, for example of the type disclosed in EP-A-529 404 or in UK-A-2 01 958, wherein the cartons of packets are overwrapped by feeding each carton, in time with a respective sheet of overwrapping material, to a feeding station of a wrapping wheel, folding the sheet into a U about the carton, joining two free end portions of the sheet to form a tubular wrapping, and, finally, closing the two ends of the tubular wrapping. The free end portions may be joined in two ways corresponding to two different formats, i.e. along a small lateral surface or a large lateral surface of the carton, and, not being retoolable to produce both formats, the wrapping machine must be changed to switch from one format to the other.

The above method involves both economic and organization drawbacks by requiring the installation of two wrapping machines, one for each format, for each production line to produce both formats and to switch rapidly from one format to the other.

SUMMARY OF THE INVENTION

It is an object of the present invention to provide a product wrapping method designed to eliminate the aforementioned drawbacks in a straightforward, low-cost manner.

According to the present invention, there is provided a method of wrapping a product, comprising the steps of feeding said product to a loading station of a folding conveyor means; feeding a respective sheet to said loading station in time with said product and in one of two different positions in relation to said product in the loading station; operating said folding conveyor means to advance the product and the relevant wrapping sheet along a folding path extending through first and second wrapping means; and operating one or the other of said wrapping means to fold said wrapping sheet into a tube about said product; the choice of one or the other of said wrapping means depending on which of said two positions is occupied by the wrapping sheet in said loading station.

The present invention also relates to a machine for wrapping products with selective functioning wrapping devices.

According to the present invention, there is provided a machine for wrapping a product, comprising a folding conveyor means to advance the product and a relevant wrapping sheet along a folding path; first and second selectively activable wrapping means arranged along said folding path and each adapted to fold said wrapping sheet into a tube about said product; a loading station arranged at a beginning of said folding path; first conveying means for feeding said product to said loading station; second conveying means for feeding said sheet to said loading station in time with said product and in one of two different positions in relation to said product in the loading station; controlling means for operating one of said wrapping means to fold said wrapping sheet into a tube about said product; said one wrapping means being chosen, in use, depending on which of said two positions is occupied by the wrapping sheet in said loading station.

BRIEF DESCRIPTION OF THE DRAWINGS

The invention will now be described by way of example with reference to the accompanying drawings, in which.

DETAILED DESCRIPTION OF THE INVENTION

Figure 1:
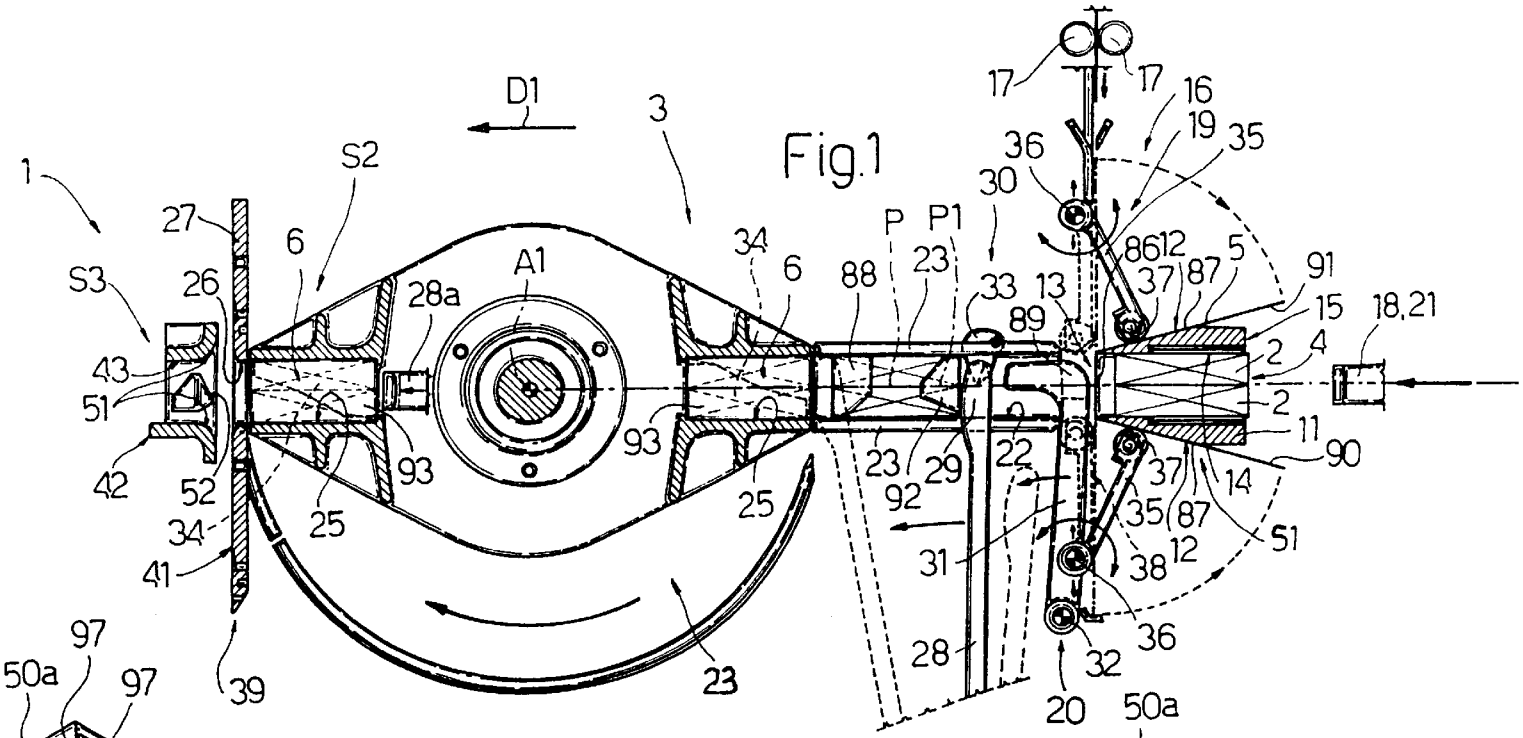
FIG. 1 shows a side view, with parts in section and parts removed for clarity, of an input portion of a wrapping machine in accordance with the present invention.
Figures 2A, 2B, 2C:
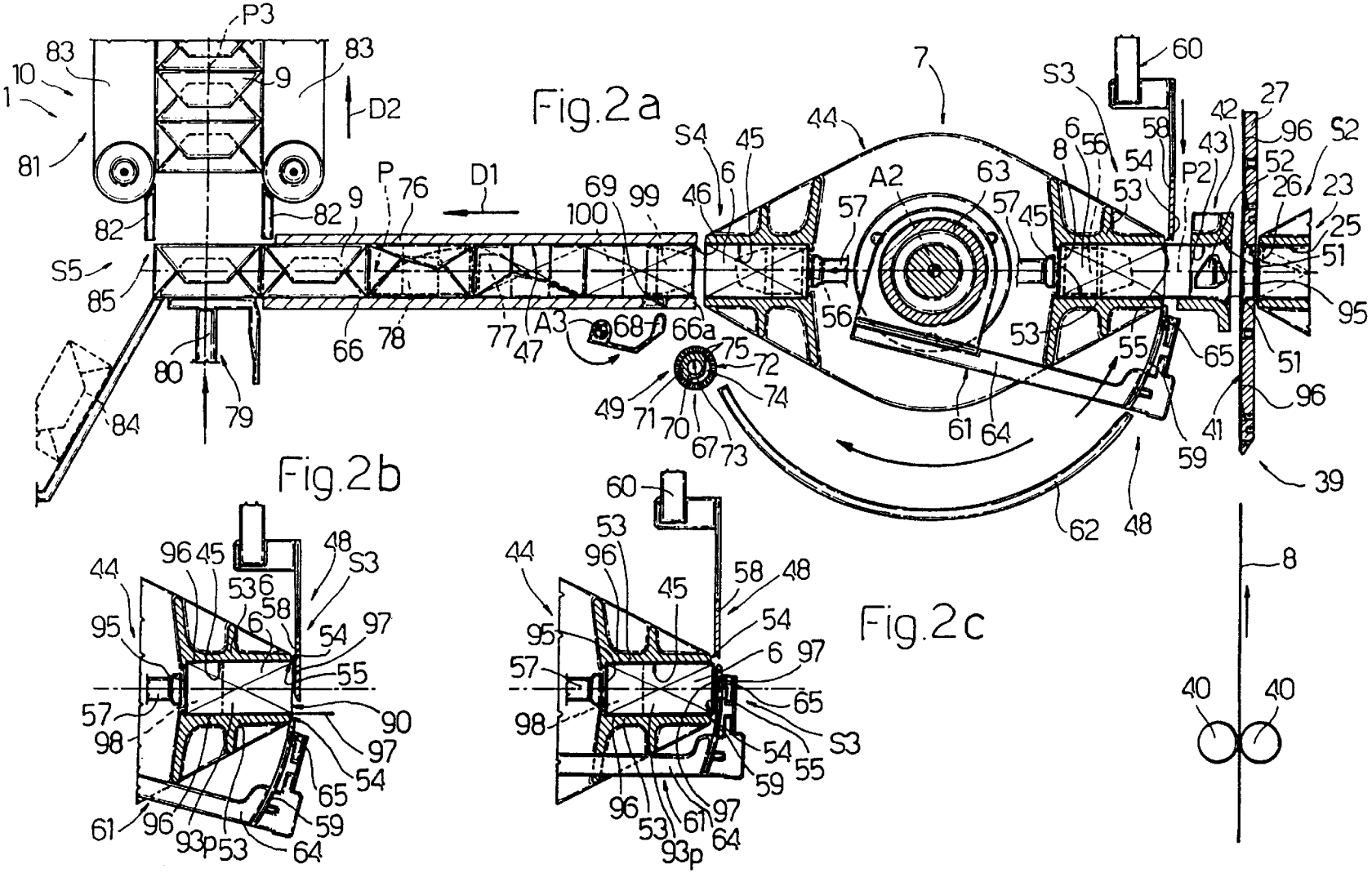
FIGS. 2*a*–2*c* show side views, with parts in section and parts removed for clarity, of an output portion of the FIG. 1 machine.
Figure 3A:
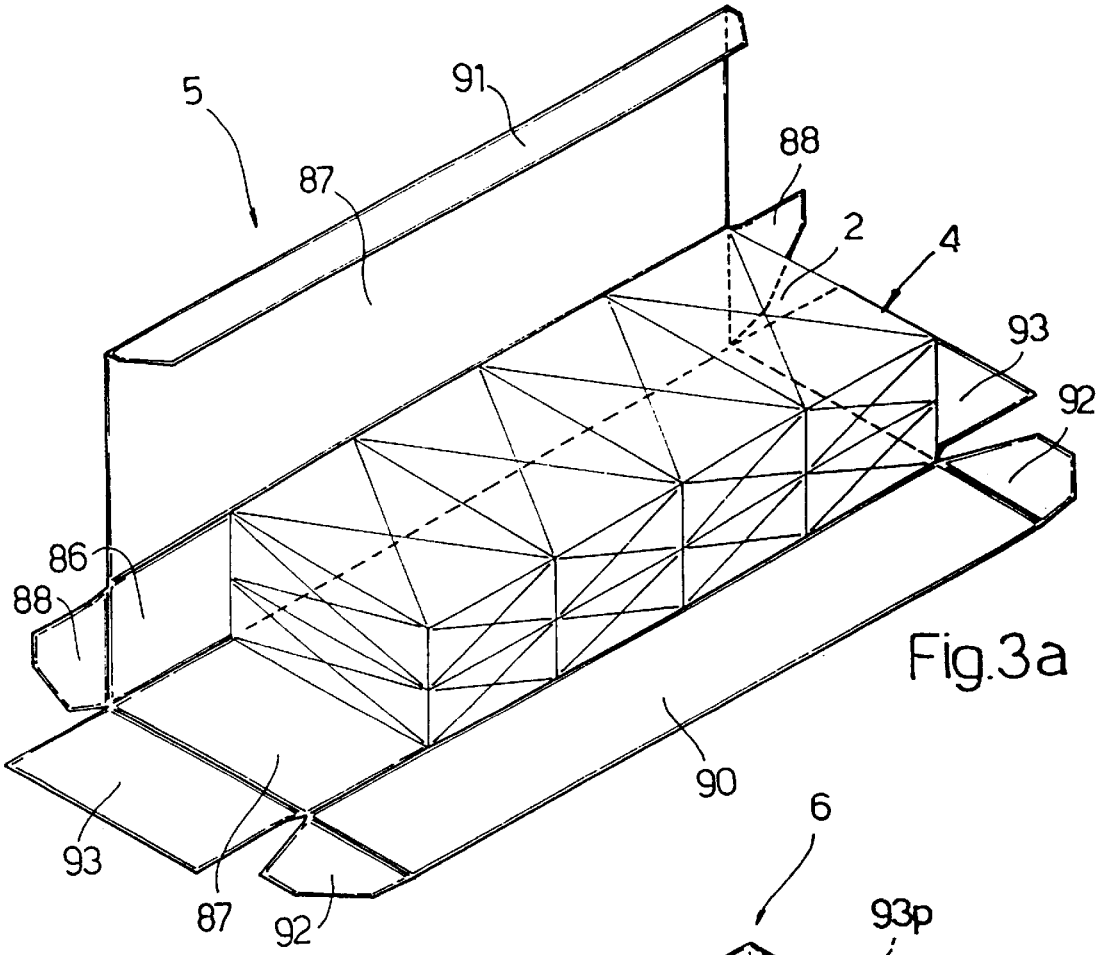
FIGS. 3*a* and 3*c* shows view in perspective, with parts in section and parts removed for clarity, of a product formed by the FIG. 1 input portion.
Figure 3B:
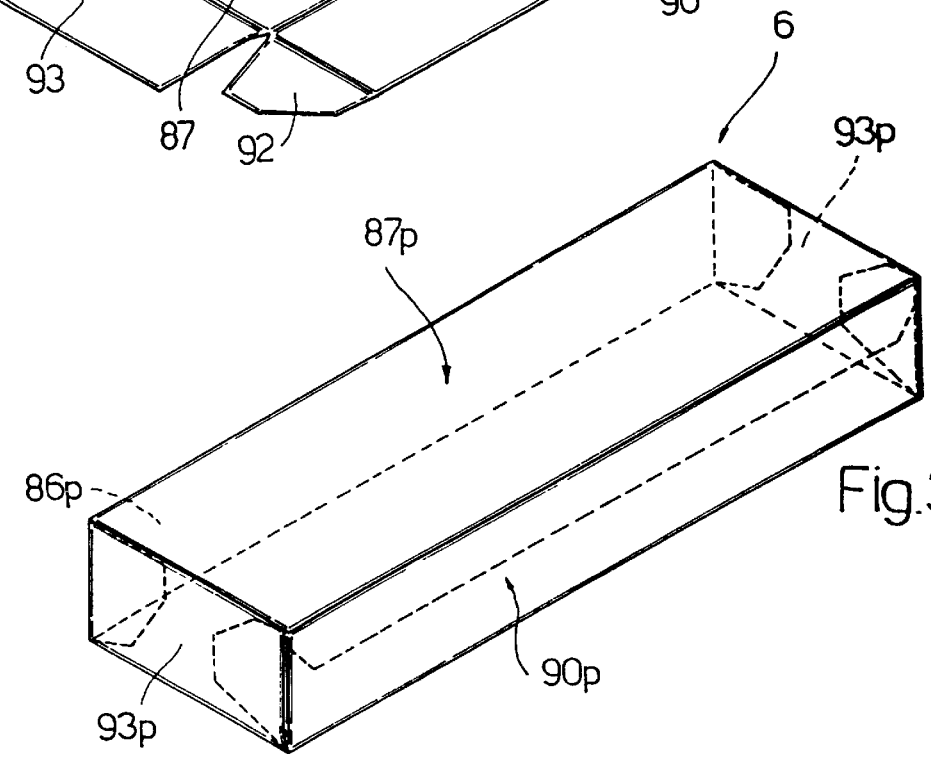

With reference to FIGS. 1, 2, 3, number 1 indicates as a whole a wrapping machine for wrapping packets 2 of cigarettes, and comprising a given wrapping path P; an input portion 3 located at the start of path P and for wrapping groups 4 of packets in respective sheets 5 of wrapping material to form respective cartons 6; an intermediate portion 7 in series with portion 3 along path P, and for overwrapping each carton 6 in a respective sheet 8 of overwrapping material to form sealed cartons 9; and an output portion 10 located substantially at the end of path P to unload cartons 9 off machine 1.

More specifically, portion 3 defines along path P an initial path P1 extending from an input station S1, where groups 4 and respective sheets 5 are supplied, to a transfer station S2 where cartons 6 are transferred to portion 7; and portion 7 defines along path P an intermediate path P2 extending from a loading station S3, adjacent to station S2 and where cartons 6 intercept respective sheets 8, to a second transfer station S5 where cartons 9 are fed to output portion 10.

Input portion 3 comprises a tubular prefolding spindle 11, which is located at station S1, is defined externally by two large lateral surfaces 12 sloping towards each other and towards a front output surface 13 of spindle 11, and in turn comprises a substantially rectangular-section inner channel 14 defined longitudinally along path P1 by surface 13 and by a rear input surface 15 parallel to surface 13 and separated from surface 13 by a distance substantially equal to the length of packets 2. Portion 3 also comprises a supply device 16 in turn comprising a pair of known rollers 17 for feeding each sheet 5 in front of surface 13 of spindle 11; and a push element 18 for feeding each group 4 of packets 2 inside channel 14 in time with respective sheet 5, and with packets 2 arranged side by side in two superimposed layers.

Portion 3 also comprises a prefolding device 19 located substantially at spindle 11, and for prefolding each sheet 5 over spindle 11; and a conveying unit 20 for feeding each group 4 and respective sheet 5 along path P1, and in turn comprising an extracting element 21 for extracting each group 4 from spindle 11 and feeding group 4 inside a further channel 22 aligned with channel 14 and defined by two parallel walls 23 on either side of path P1. Portion 3 also comprises a pocket conveyor 24 defined by a wheel rotating in steps about an axis A1 crosswise to the traveling direction D1 of groups 4, and in turn comprising at least two U-shaped peripheral pockets or seats 25 movable back and forth between a loading position, in which each pocket 25 faces and is aligned with the output of channel 22, and an unloading position, in which each pocket 25 faces an opening 26 in a known supply plate 27 for supplying sheets 8 and extending crosswise to direction D1 between stations S2 and S3.

Conveying unit 20 also comprises a push arm 28, which is of a width substantially equal to the width of channel 22, is mounted substantially crosswise to path P1 so as to rotate eccentrically about an axis (not shown) parallel to axis A1, and in turn comprises a shaped end 29 which is inserted inside channel 22 through an opening formed in bottom wall 23 to push each group 4 and respective sheet 5 along channel 22 and into a pocket 25 in the loading position. Conveying unit 20 also comprises a known push element 28*a* movable back and forth along path P1 to engage a pocket 25 arrested in station S2, unload respective carton 6 from pocket 25, and feed carton 6 through opening 26 and along an initial portion of path P2.

Portion 3 also comprises a folding unit 30 for folding each sheet 5 about respective group 4, and in turn comprising, in addition to prefolding device 19 and shaped end 29, two L-shaped folding elements 31 (only one shown) fitted to a pin 32 parallel to axis A1, and extending from pin 32 alongside channel 22; a further folding element 33 fitted in rotary manner to top wall 23 to engage channel 22 at the passage of each group 4; and, alongside each pocket 25, two helical folding plates 34 fitted to conveyor 24.

More specifically, device 19 comprises two swing plates 35 mounted for rotation about respective pins 36 on either side of path P1; and two rollers 37 fitted to the free ends of plates 35. Pins 36 are powered to swing plates 35 and respective rollers 37 between a rest position (shown by the dash line in FIG. 1). in which plates 35 are aligned vertically with each other to define a feed surface 38 for sheets 5 crosswise to path P1, and a prefolding position in which plates 35 are inclined with respect to path P1, and respective rollers 37 are positioned on sheet 5 and substantially on surfaces 12 of spindle 11 to prefold sheet 5 substantially into a U about two respective known preformed bend lines (not shown). Pins 36 are also slidable to and from each other to increase or reduce their center distance and so roll respective rollers 37 along surfaces 12 and also permit a change in the format of groups 4.

Intermediate portion 7 comprises a supply device 39 for supplying sheets 8, and which is timed with conveyor 24 and with push element 28*a,* and in turn comprises plate 27 and two known rollers 40 for feeding sheets 8 along the surface 41 of plate 27 on the opposite side to conveyor 24; a further tubular prefolding spindle 42 located along path P2, downstream from plate 27, and in turn comprising an inner channel 43 aligned with opening 26 and for the passage of cartons 6 fed forward by element 28*a* together with respective sheets 8; a further pocket conveyor 44 defined by a wheel rotating in steps about an axis A2 parallel to axis A1, and in turn comprising at least two U-shaped peripheral pockets or seats 45 movable back and forth between a loading position, in which each pocket 45 faces and is aligned with the output of channel 43, and an unloading position, in which each pocket 45 faces an input opening 46 of a further channel 47 for feeding cartons 6 and extending towards station S5 from an unloading station S4 defined by opening 46; and two wrapping devices 48 and 49 located substantially at stations S3 and S4, and which may be activated selectively to wrap a respective sheet 8, and so form a tubular wrapping 50 (FIGS. 4 and 6), about each carton 6.

More specifically, channel 43 of spindle 42 comprises two rounded long input edges 51 for prefolding into a U each sheet 8 engaged by respective carton 6 traveling through opening 26; and two wedges 52 located on either side of path P2 and extending inside channel 43 to engage each sheet 8 on either side of respective carton 6 and prevent sheet 8 from sliding with respect to carton 6 as it is prefolded. Each pocket 45 is, as stated, U-shaped, and comprises two parallel large lateral walls 53, which act as folding plates for finally folding each sheet 8 into a U about carton 6 as sheet 8 and carton 6 are inserted inside pocket 45, and the respective free edges 54 of which define a peripheral opening 55 for the insertion of cartons 6 inside pocket 45. Each pocket 45 also comprises two folding plates 56 (only one shown) located substantially on either side of opening 55; and a known push element 57 for unloading pocket 45 at station S4.

Folding device 48 comprises two folding plates 58 and 59 located on either side of station S3 and for engaging opening 55 of a pocket 45 arrested in station S3 with opening 55 crosswise to direction D1; and two actuators 60 and 61 for activating plates 58 and 59. More specifically, plate 58 is defined by a flat plate, and is moved, crosswise to direction D1 by respective actuator 60, between a rest position (FIGS. 2*a* and 2*c*), and a folding position (FIG. 2*c*) partially closing opening 55; and plate 59 is defined by a substantially cylindrical plate, and is rotated, about axis A2 by respective actuator 61, between a rest position (FIGS. 2*a* and 2*b*) defining an end portion of a cylindrical wall 62 coaxial with axis A2 along the periphery of conveyor 44 between stations S3 and S4, and a folding position (FIG. 2*c*) partially closing opening 55 of a pocket 45. Actuator 61 comprises a powered shaft 63 coaxial with axis A2; and an arm 64 fitted to shaft 63 and supporting plate 59 and a sealing head 65 extending towards axis A2 through a slot formed in plate 59.

Wrapping device 49 comprises, in addition to wall 62, a wall 66 extending along path P2 to define the bottom wall of channel 47, and having an input edge 66*a* facing conveyor 44 and acting as a fixed folding element; a retaining device 67 located at the opposite end of wall 62 to plate 59; and a further sealing head 68 fitted beneath wall 66, rotating about an axis A3 parallel to axis A2, and which is inserted inside channel 47 through an opening 69 formed crosswise to direction D1 through wall 66. More specifically, retaining device 67 comprises a tubular cylinder 70 rotating idly on a shaft 71 parallel to axis A2; and a pneumatic distributor 72 having a suction conduit 73 formed along shaft 71, and a longitudinal groove 74 formed along the outer surface of shaft 71, on the side of shaft 71 substantially facing wall 62, to connect conduit 73 to some of a number of radial holes 75 formed through cylinder 70.

Intermediate portion 7 also comprises a wall 76 parallel to wall 66 and defining the top wall of channel 47; two pairs of known helical folding devices in series along the sides of channel 47; and a supply head 79 located at station S5 and moved crosswise to direction D1 by a respective linear actuator 80 to feed cartons 9 to portion 10.

Output portion 10 defines an output path P3 along path P, and comprises a conveyor 81 for feeding cartons 9 in a direction D2 crosswise to direction D1, and which is defined by two belt conveyors 83 on either side of path P3, and by two plates 82 located on either side of path P3 at station S5 and extending from and crosswise to top wall 76 of channel 47. More specifically, the plate 82 furthest away from wall 76 in direction D1 defines, with a further inclined plate 84 extending from the opposite side of channel 47 to plate 82 and from the level of wall 66, an opening 85 by which to reject any cartons 9.

Operation of machine 1 will now be described with reference to one group 4 of packets 2, and as of the instant in which group 4 has been fed into spindle 11, and respective sheet 5 has been fed by device 16 in front of front surface 13 of spindle 11 and onto the surface 38 defined by plates 35 in the rest position. More specifically, each sheet 5 is positioned in front of spindle 11 with a small longitudinal panel 86 of the sheet over the output opening of channel 14, and with two large longitudinal panels 87, connected to panel 86 along respective known preformed bend lines, contacting plates 35.

As of the above instant, plates 35 are swung about respective pins 36 so that respective rollers 37 roll along panels 87 to substantially prefold sheet 5 into a U and roll panels 87 onto surfaces 12 of spindle 11. Once sheet 5 is prefolded, plates 35 and extracting element 21 are activated substantially simultaneously, so that group 4, as it travels along path P1, engages panel 86 to gradually remove sheet 5 from spindle 11, while plates 35, as they swing back into the rest position, accompany sheet 5 towards channel 22 and finally fold sheet 5 into a U by means of rollers 37. Between channel 14 and channel 22, two tabs 88, extending from opposite sides of panel 86 and connected to panel 86 by respective preformed bend lines, are folded squarely onto packets 2 by respective elbows 89 of folding elements 31; and, as extracting element 21 withdraws to release group 4, shaped end 29 is inserted inside channel 22, behind group 4, to engage and squarely fold a further small longitudinal panel 90 connected to bottom panel 87 and identical with panel 86. As panel 90 is being folded, and before it actually contacts group 4, folding element 33 engages a longitudinal tongue 91 connected to top panel 87, and folds tongue 91 squarely between group 4 and panel 90. At this point, it should be pointed out that each sheet 5 is fed in front of spindle 11 so that panel 87 comprising tongue 91, and therefore defining the lid of carton 6, is positioned above spindle 11, and carton 6 is inserted inside pocket 25 with said lid facing upwards.

At this point, folding elements 31 are rotated (anticlockwise in FIG. 1) about pin 32 to engage and squarely fold onto group 4 a further two tabs 92 extending from opposite sides of panel 90 and connected to panel 90 along respective preformed bend lines; and, once tabs 92 are folded, shaped end 29, before withdrawing into its original position, is moved forward along a final portion of its travel to insert group 4 and the partially folded sheet 5 inside a pocket 25 in the loading position. As group 4 is inserted inside pocket 25, a further two panels 93, extending from opposite sides of panel 87 and connected to panel 87 along respective preformed bend lines, are folded square by plates 34 of pocket 25 onto tabs 88 and 92 (gummed beforehand in known manner) to form a carton 6 comprising two small lateral walls 86*p*, 90*p* defined respectively by panels 86, 90, two large lateral walls 87*p* defined by panels 87, and two end walls 93*p* defined externally by panels 93. More specifically, when carton 6 is fully inserted inside pocket 25 in the loading position at station S1, said lid is defined by the upward-facing wall 87*p*, while the downward-facing wall 87*p* defines the bottom wall of carton 6.

Once carton 6 is fed into pocket 25, conveyor 24 is activated to rotate pocket 25 about axis A1 and transfer carton 6 from station S1 to station S2, where carton 6 is extracted from pocket 25 by push element 28*a* and fed from path P1 to path P2 through opening 26 in plate 27, onto the surface 41 of which a sheet 8 has by this time been fed by device 39. More specifically, and as shown in FIGS. 2*a*, 2*b*, 2*c*, sheet 8 is fed onto surface 41 with an intermediate portion 95 closing opening 26, and with two lateral portions 96 of equal length on opposite sides of opening 26.

As element 28*a* feeds carton 6 through opening 26 and spindle 42, wall 86*p* of carton 6 engages and pushes intermediate portion 95 of sheet 8 towards channel 43, and lateral portions 96 are gradually detached from plate 27 and, sliding over input edges 51 of channel 43, are gradually folded onto walls 87*p*, so as to fold sheet 8 into a U about carton 6. Element 28*a* feeds carton 6 along path P2 until carton 6 and sheet 8 are inserted inside a pocket 45 at station S3 with sheet 8 folded completely into a U and with an end portion 97 of each portion 96 projecting from wall 90*p* and outwards of pocket 45 through peripheral opening 55; and, as carton 6 is inserted inside pocket 45, portions 98 of sheet 8 projecting from end walls 93*p* of carton 6 are folded squarely onto walls 93*p* by plates 56.

Figure 4:
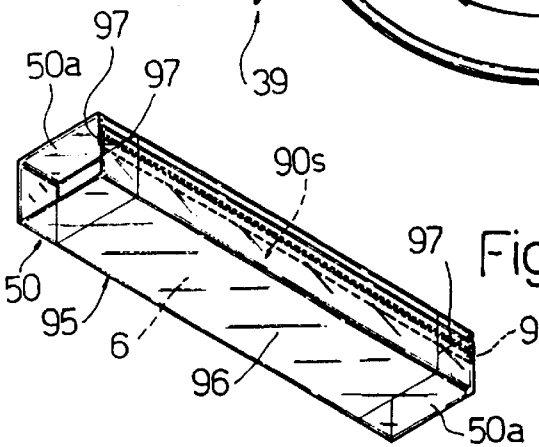
FIG. 4 shows a view in perspective of the FIG. 3 product wrapped in a tubular wrapping formed by the output portion in FIG. 2.

At this point, actuator 60 moves folding plate 58 towards opening 55 to fold the first end portion 97—squarely onto a small lateral wall 90*p* of carton 6; and, when plate 58 is restored to the rest position, actuator 61 rotates arm 64 about axis A2 to move folding plate 59 towards opening 55 (FIG. 2*c*) and fold the relative end portion 97—squarely onto wall 90*p* and partially and on top of end portion 97 to form the tubular wrapping 50 in FIG. 4. Once the two end portions 97 have been folded one on top of the other, conveyor 44 rotates pocket 45 (clockwise about axis A2 in FIG. 2) from station S3 to station S4, and, over a first portion of the rotation of conveyor 44 corresponding with the rotation of arm 64 about axis A2, sealing head 65 is activated to seal end portions 97 to each other.

As pocket 45 is arrested at station S4, push element 57 unloads pocket 45 and feeds carton 6 into channel 47 and between two plates 99 (only one shown) similar to plates 56 and located on either side of channel 47 to fold respective portions 100 of sheet 8, similar to portions 98 and projecting from walls 93*p*. From this point on, carton 6 is fed along channel 47 and sheet 8 is folded by helical folding devices 77 and 78 as further cartons 6 are fed into channel 47, each of which pushes forward the cartons 6 already inside the channel to feed sealed cartons 9 to station S5, in that channel 47 not only provides for finish folding the open ends 50*a* of wrapping 50 about carton 6, but also for sealing ends 50*a* in known manner (not shown). More specifically, each carton 9 is fed to station S5 with respective carton 6 positioned with the lid-defining wall 87*p* facing the two belt conveyors 83, and with the bottom-wall-defining wall 87*p* facing supply head 79, which therefore acts on the bottom wall of carton 6 to feed carton 9 towards conveyors 83.

Figure 6:
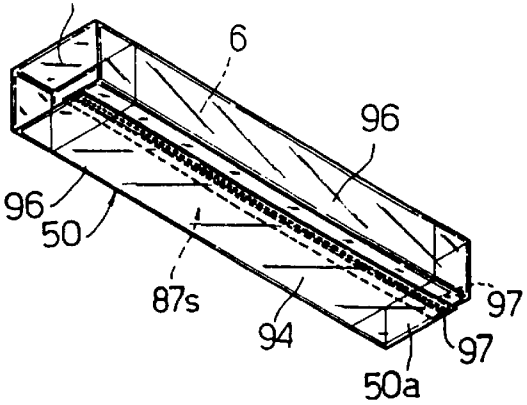
FIG. 6 shows a view in perspective of a product wrapped in a tubular wrapping formed by the output portion in FIG. 5.
Figures 5A, 5B, 5C:
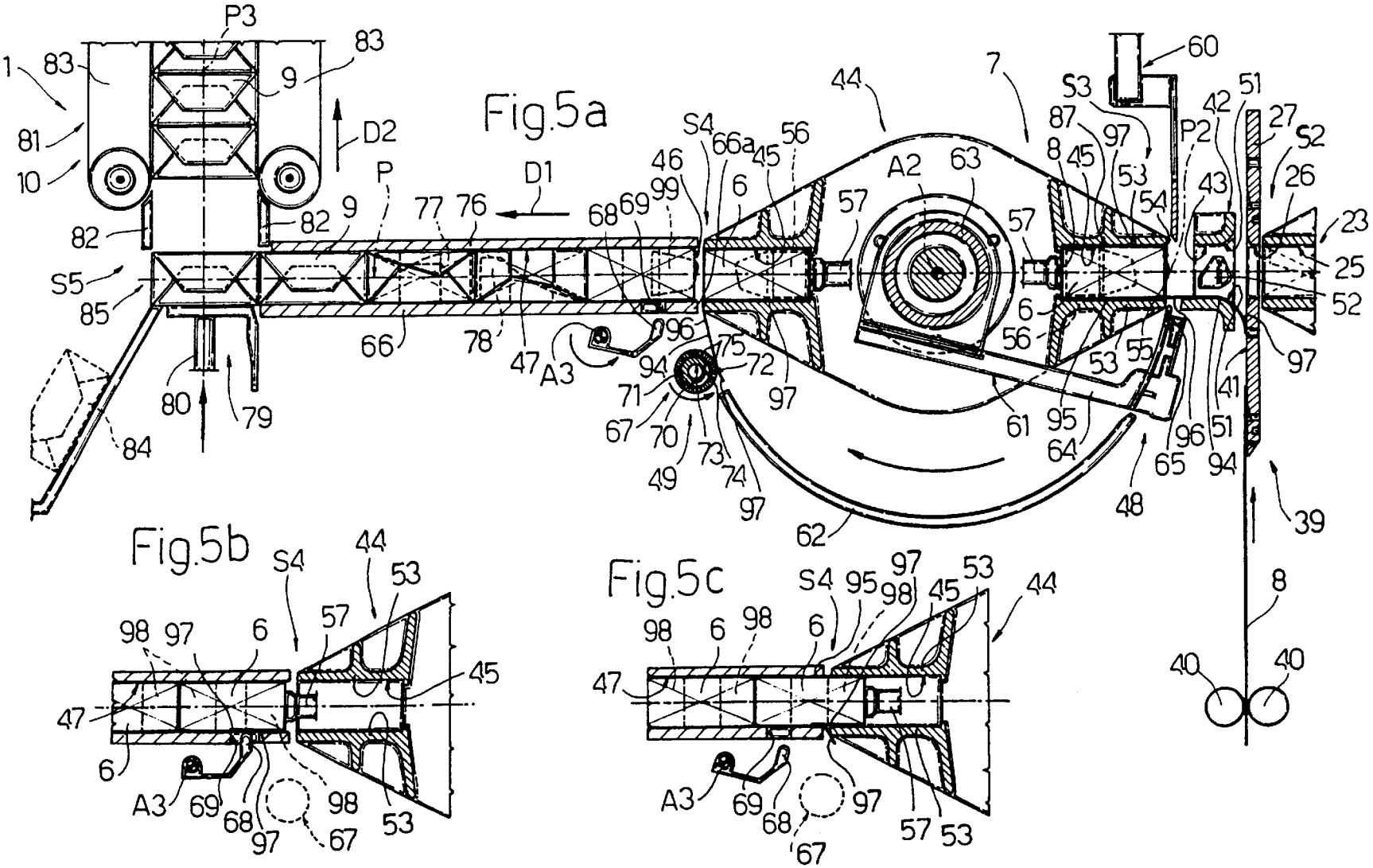
FIGS. 5*a*–5*c* show side views, with parts in section and parts removed for clarity, of the FIG. 2 output portion in an alternative operating configuration to that in FIG. 2.

In FIGS. 5 and 6, as opposed to being superimposed and sealed on small lateral wall 90*p* of carton 6 by activating wrapping device 48, end portions 97 are superimposed and sealed on a large lateral wall 87*p* and crosswise to wall 90*p*. More specifically, each sheet 8 is positioned on plate 27 with intermediate portion 95 to one side of opening 26 in plate 27, so that, as opposed to engaging the center of sheet 8, wall 86*p* of carton 6 fed through opening 26 engages one of the two lateral portions 96.

When carton 6 is inserted inside pocket 45, therefore, sheet 8 is still folded into a U, but with the difference that end portion 97 is folded immediately onto wall 87*p*, while a lateral portion 94 of sheet 8, defined by end portion 97 and by part of the relative lateral portion 96, is left projecting outwards of pocket 45 through opening 55. When conveyor 44 is rotated about axis A2 (clockwise in FIG. 5), portion 94 outside pocket 45 collides with plate 59 stationary in the rest position—in which plate 59 defines an end portion of wall 62 and therefore forms part of wrapping device 49—and is substantially prefolded onto surface 90*s*, leaving at least end portion 97 projecting with respect to wall 87*p*.

As pocket 45 approaches station S4, retaining device 67 is activated to draw portion 94 by suction onto tubular cylinder 70 as portion 94 is released from wall 62, so that portion 94 remains attached to device 67 when pocket 45 is arrested in station S4, and device 67 draws sheet 8 tightly about carton 6 as push element 57, simultaneously gripping sheet 8 on wall 90*p*, begins unloading pocket 45. More specifically, as carton 6 and sheet 8 are extracted simultaneously from pocket 45 and portion 94 of sheet 8 contacts cylinder 70, cylinder 70 is rotated about shaft 71 as long as portion 94 is retained by suction on cylinder 70, i.e. as long as holes 75 are located over groove 74 and therefore communicate with suction conduit 73.

As the still projecting end portion 97 reaches cylinder 70 and slides past the surface portion of cylinder 70 affected by groove 74, sheet 8 is released completely by device 67 and folded onto wall 87*p*. That is, as carton 6 is inserted inside channel 47 by element 57, portion 94 is released gradually by device 67, is folded towards wall 87*p* by edge 66*a*, and is folded squarely onto wall 87*p* as this is gradually exposed as carton 6 is expelled from pocket 45. Once carton 6 is expelled completely from pocket 45 and inserted inside channel 47, and the two end portions 97 are folded one on top of the other and both on top of wall 87*p* to form the tubular wrapping 50 in FIG. 6, sealing head 68 is rotated about axis A3 and through opening 69 to contact and seal end portions 97; from which point on, ends 50*a* of tubular wrapping 50 are folded in the same way as described previously.

We claim:

1. A method of wrapping a product substantially shaped as a parallelepiped having first and second parallel small lateral walls and first and second parallel large walls in a wrapping sheet having an intermediate portion, and first and second lateral portions comprising respective free end portions, the method comprising the following steps:

a) feeding said product to a loading station of a folding conveyor movable along a transfer path extending from said loading station and an unloading station;

b) feeding a respective wrapping sheet to said loading station in time with said product and in one of a first and second positions in relation to said product in the loading station; in said first position said intermediate portion facing said first small lateral wall in said loading station and, in said second position, said first lateral portion facing said first lateral wall in said loading station;

c) folding said wrapping sheet into a U-shape about said product in said loading station;

d) operating said folding conveyor to advance the product and the relevant wrapping sheet along a folding path extending through first and second wrapping means;

e) selecting the first or the second wrapping means;

f) operating the selected wrapping means to fold said wrapping sheet into a tube about said product;

wherein the selection step of the wrapping means depends on which of said two positions is occupied by the wrapping sheet in said loading station such that said first wrapping means being operational and said second wrapping means being inactive when said wrapping sheet is fed in said first position, whereas said second wrapping means being operational and said first wrapping means being inactive when said wrapping sheet is fed in said second position;

h) folding said wrapping sheet into a tube about said product by one of said first and second wrapping means;

i) superimposing said first and second end portions of the wrapping sheet by one of said first and second wrapping means;

wherein said first wrapping means are located in said loading station and are used in connection with said sheet being arranged in said first position to superimpose said two free end portions on said second small lateral wall; and said second wrapping means are located in said unloading station and are used in connection with said sheet being arranged in said second position to superimpose said two free end portions on said first large lateral wall of said product.

2. A method as claimed in claim 1, further comprising the steps of:

a) advancing said product and said sheet along said folding path from said loading station to said unloading station by means of a transfer seat movable along said first path; said second small lateral wall being an exposed wall outside said transfer seat at said loading station; and b) exposing outside said transfer seat said first large, lateral wall at said unloading station.

3. A method as claimed in claim 2, wherein, when said wrapping sheet is fed to said loading station in said first position, said two free end portions of said wrapping sheet folded into a U-shape about the respective product project outwards from said transfer seat and crosswise to said second small lateral wall; the two free end portions being folded one on top of the other by moving two folding elements located on either side of said loading station, successively towards said first lateral wall.

4. A method as claimed in claim 2 or 3, wherein, when said wrapping sheet is fed to said loading station in said second position, said wrapping sheet, folded into a U-shape about the respective product, has a first of said two free end portions projecting outwards from said transfer seat, and a second of said two free end portions positioned contacting said first large lateral wall; said method further comprising the step of: folding the first free end portion on top of the second free end portion by a fixed folding element located at said unloading station.

5. A method as claimed in claim 4, further comprising the step of releasably retaining at least said second free end portion so as to draw the sheet of wrapping material tightly onto the respective product as the product and respective sheet are unloaded from said transfer seat at said unloading station.

6. A method as claimed in claim 1, wherein each said product comprises a group of packets of cigarettes, and a further sheet of wrapping material; the method comprising the steps of: wrapping said further sheet of wrapping material about said group at a wrapping station and by means of third wrapping means, the wrapping station being located along a second given path having an end portion defined by said loading station; further folding said further sheet by means of folding means located along said second path, between said wrapping station and said loading station; and feeding said group, together with the folded said further sheet, to said loading station.

7. A method as claimed in claim 6, wherein said third wrapping means comprise two oscillating elements on either side of said second path; and a tubular forming spindle located along said second path, in a substantially intermediate position between the oscillating elements; said method further comprising the step of: prefolding said further sheet of wrapping material onto respective outer surfaces of said spindle by moving said oscillating elements to and from said outer surfaces.

8. A method as claimed in claim 7, wherein each said further sheet of wrapping material comprises a central panel, and two lateral panels extending from opposite sides of the central panel; at least one of the lateral panels defining a lid wall of the respective product; said method comprising the step of: supplying said further sheet to said wrapping station with the central panel facing said spindle, and with the lateral panel defining said lid wall located above the spindle.

9. A machine for wrapping a product substantially shaped as a parallelepiped having first and second parallel small lateral wall and first and second parallel large wall in a wrapping sheet having an intermediate portion, and first and second lateral portions comprising respective end portions, the machine comprising:

a) a folding conveyor comprising at least a transfer seat to advance the product and a relevant wrapping sheet along a folding path substantially circular and extending about a first given axis, and at least between a loading station and an unloading station of said product and said wrapping sheet;

b) first and second selectively and alternatively activatable wrapping means arranged along said folding path and each adapted to fold said wrapping sheet into a tube about said product;

c) said loading station being arranged at a beginning of said folding path and comprising said first wrapping means;

d) said unloading station being arranged at the end of said folding path and comprising said first wrapping means;

e) first conveying means for feeding said product to said loading station;

f) second conveying means for feeding said sheet to said loading station in time with said product and in one of a first and a second positions in relation to said product in the loading station; the wrapping sheet in said first position having an intermediate portion facing said first small lateral wall of said product in said loading station and, the wrapping sheet in said first position having said second lateral portion facing said first small lateral wall in said loading station;

g) control means for operating one of said first and second wrapping means to fold said wrapping sheet into a tube about said product; said first wrapping means being activated when said sheet is fed in said first position in said loading station, and said second wrapping means is activated when said wrapping sheet is fed in said second position in said loading station;

h) said first wrapping means comprising two folding elements located on either side of said loading station and movable successively towards said transfer seat, arrested at the loading station, to fold said first and second end portions one on top of the other on said first lateral wall; said folding conveyor rotating said transfer seat about said first given axis and in a given rotation direction from said loading station; and a first folding element of said two folding elements being located along said folding path, downstream from said loading station in said rotation direction.

10. A machine as claimed in claim 9, wherein said first conveying means comprise first folding means for folding said wrapping sheet into a U-shape about said product; each said wrapping means being adapted to fold said wrapping sheet into a tube about said product by superimposing said first and end portions of the wrapping sheet.

11. A machine as claimed in claim 10, wherein said product is substantially shaped as a parallelepiped having first and second parallel small lateral walls and first and second parallel large lateral walls; said first wrapping means being adapted to superimpose said first and second end portions on said first of said small lateral walls; and said second wrapping means being adapted to superimpose said two end portions on said first large lateral wall of said product.

12. A machine as claimed in claim 11, wherein said first wrapping means comprise respective sealing means for joining said two free end portions integrally to each other on said first small wall.

13. A machine as claimed in claim 12, wherein said first folding element is mounted for rotation, about said first given axis, between a rest position along said folding path and downstream from said loading station in said rotation direction, and a folding position partially contacting said first small lateral wall.

14. A machine as claimed in claim 13, wherein said sealing means are integral with said first folding element, and are movable, together with said transfer seat, along a given arc of said folding path and about said first given axis from said loading station.

15. A machine as claimed in claim 12, wherein said seat comprises extracting means and said second wrapping means comprise a fixed folding element located at said unloading station and cooperating with said extracting means to fold a first end portion on top of said second end portion located on said first large lateral wall.

16. A machine as claimed in claim 15, further comprising retaining means located at said unloading station to releasably retain at least said second end portion to draw the respective sheet of wrapping material tightly onto the respective product as the product and the sheet of wrapping material are unloaded from said transfer seat.

17. A machine as claimed in claim 16, wherein said second wrapping means comprise respective sealing means for joining said two free end portions integrally to each other on said first large lateral wall.

18. A machine as claimed in claim 9, wherein said second wrapping means comprises a respective folding element located along said folding path, downstream from said loading station in said rotation direction.

19. A machine as claimed in claim 9, wherein each said product comprises a group of packets of cigarettes, and a further sheet of wrapping material; the machine comprising third wrapping means for wrapping said further sheet of wrapping material about said group at a wrapping station, the wrapping station being located along a second given path having an end portion defined by said loading station; folding means located along said second path, between said wrapping station and said loading station, to o further fold said further sheet; and further conveying means for feeding said group together with the folded said further sheet to said loading station.

20. A machine as claimed in claim 19, wherein said third wrapping means comprise two oscillating elements on either side of said second path; and a tubular forming spindle located along said second path, in a substantially intermediate position between the oscillating elements; said oscillating elements being movable to and from respective outer surfaces of said spindle to prefold said further sheet of wrapping material onto said outer surfaces.

21. A machine as claimed in claim 20, wherein said oscillating elements comprise respective oscillating plates and respective rollers fitted in rotary manner to the plates; the plates being mounted on respective pins, the center distance of which is variable.

* * * * *

UNITED STATES PATENT AND TRADEMARK OFFICE

CERTIFICATE OF CORRECTION

PATENT NO : 6,035,612
DATED : March 14, 2000
INVENTOR(S) : Fiorenzo Draghetti and Silvano Boriani It is certified that error appears in the above-identified patent and that said Letters Patent are hereby corrected as shown below:

The Assignee (Item [73])

"Societa Per Azioni"

to

--G. D Societa Per Azioni--

Signed and Sealed this

Third Day of April, 2001

*Attest:*

Nicholas P. Godici

NICHOLAS P. GODICI

*Attesting Officer*

*Acting Director of the United States Patent and Trademark Office*